US007452581B2

(12) United States Patent
Levine et al.

(10) Patent No.: US 7,452,581 B2
(45) Date of Patent: Nov. 18, 2008

(54) STAGGERED, DISCONTINUOUS WEAR PROTECTION FOR SEAMS

(75) Inventors: Mark J. Levine, Hendersonville, TN (US); John VanHandel, Appleton, WI (US)

(73) Assignee: Albany International Corp., Albany, NY (US)

( * ) Notice: Subject to any disclaimer, the term of this patent is extended or adjusted under 35 U.S.C. 154(b) by 427 days.

(21) Appl. No.: 11/269,220

(22) Filed: Nov. 8, 2005

(65) Prior Publication Data

US 2006/0141199 A1 Jun. 29, 2006

Related U.S. Application Data

(60) Provisional application No. 60/626,217, filed on Nov. 9, 2004.

(51) Int. Cl.
*B32B 3/02* (2006.01)

(52) U.S. Cl. ..... 428/58; 139/383 AA

(58) Field of Classification Search ..... 428/58, 428/61; 139/383 AA, 383 A; 162/904; 474/253, 474/268–271
See application file for complete search history.

(56) References Cited

U.S. PATENT DOCUMENTS

| | | | | | |
|---|---|---|---|---|---|
| 1,747,272 | A | * | 2/1930 | Webb | 245/10 |
| 5,275,024 | A | | 1/1994 | Parks | |
| 5,460,261 | A | * | 10/1995 | Kusel et al. | 198/819 |
| 5,701,638 | A | * | 12/1997 | Schick | 24/33 P |
| 5,791,383 | A | | 8/1998 | Eckhardt | |
| 6,117,274 | A | * | 9/2000 | Yook | 162/358.2 |
| 2004/0143937 | A1 | | 7/2004 | Allen | |

* cited by examiner

*Primary Examiner*—Alexander Thomas
(74) *Attorney, Agent, or Firm*—Frommer Lawrence & Haug LLP; Ronald R. Santucci

(57) ABSTRACT

The invention relates to an industrial fabric having means for seaming a fabric to form an endless loop and a plurality of non-continuous wear beads formed on the fabric proximally to a seam formed in the fabric which prevent wear to the components of the seam.

8 Claims, 2 Drawing Sheets

STAGGERED, DISCONTINUOUS WEAR PROTECTION FOR SEAMS

CROSS-REFERENCE TO RELATED APPLICATIONS

This application is based upon and claims the benefit of U.S. Provisional Patent Application Ser. No. 60/626,217 filed Nov. 9, 2004 entitled "STAGGERED, DISCONTINUOUS WEAR PROTECTION FOR SEAMS", the disclosure of which is incorporated herein by reference.

FIELD OF THE INVENTION

The present invention is directed towards means for preventing wear of seamed portions of industrial fabrics used in papermaking related processes.

BACKGROUND OF THE INVENTION

The production of paper begins with the processing of wood. Wood is chiefly composed of two major substances; both are organic, that is, their molecules are built around chains and rings of carbon atoms. Cellulose, which occurs in the walls of the plant cells, is the fibrous material that is used to make paper. Lignin is a large, complex molecule; it acts as a kind of glue that holds the cellulose fibers together and stiffens the cell walls, giving wood its mechanical strength. In order to convert wood into pulp suitable for making paper, the cellulose fibers must be freed from the lignin. In mechanical pulping this is done by tearing the wood fibers apart physically to create groundwood pulp, leaving most of the lignin intact in the pulp. The high lignin content of groundwood pulp leaves the paper products weak and prone to degradation (e.g. yellowing) over time. Mechanical pulp is used principally to manufacture newsprint and some magazines.

In most pulp production lignin is separated from the fibers chemically. For example, in the kraft process, wood chips are heated ("cooked") in a solution of sodium hydroxide and sodium sulfide. The lignin is broken down into smaller segments and dissolves into the solution. In the next step, "brownstock washing," the breakdown products and chemicals are washed out of the pulp and sent to the recovery boiler. Kraft unbleached pulp has a distinctive dark brown color, due to darkened residual lignin, but is nevertheless exceptionally strong and suitable for packaging, tissue and toweling.

For brighter and more durable products the pulp must be bleached. In the bleaching process, the color in the residual lignin is either neutralized (by destroying the chromophoric groups) or removed with the lignin. This process traditionally has been accomplished for kraft pulp by chlorine bleaching, usually followed by washing and extraction of the chemicals and breakdown products. This process is not much different than washing clothes, the stains imbedded in cloth fibers are either neutralized by bleach, or broken down and washed out.

In current pulp production processes, the lignin solution typically undergoes two or more separate washing operations. For example, the groundwood or wood chips are first processed with chemicals under pressure and temperature, usually by either the kraft process or by the sulfite acid process. In either process, digestion dissolves the lignins thereby freeing the fibers and placing the lignin components into solution. In both processes the resulting liquid is dark in color, and the residual liquid which does not drain from the pulp and the remaining contaminants must be washed from the pulp. Further, it is desirable to recover spent liquid at as high a concentration as practical to minimize the cost of the subsequent recovery of chemicals.

Brown pulp which has been so washed retains a definite brown color and the pulp which remains is usually too highly colored for making white paper. Also, if any lignin is present, paper made from such pulp may not have a high degree of permanence and will yellow in time. Therefore, it is common and conventional to apply a bleaching process to the pulp, not only to improve whiteness, but to improve permanence of the whiteness.

Bleaching may not be accomplished in a single stage and may be performed in two or more stages, each followed by washing. After bleach treatments, the pulp is subjected to a washing action to remove the water which contains the spent bleaching agents and dissolved lignin.

One particular type of industrial fabric, which is used in such application, is the pulp washing fabric, which is used, for example, in the Black Clawson Chemi Washer.

U.S. Pat. No. 5,275,024 shows an example of a current belt-type pulp washing machine that includes a dewatering stage (or "formation zone") and multiple counter-current washing stages (or collectively "displacement zone"). The machine employs an endless moving foraminous belt which extends about a breast roll defining an on-running end and a couch roll defining an off-running end, with a generally horizontal upper run of the belt extending between the rolls. A series of suction boxes located underneath the belt provides for initial dewatering of the pulp in the formation zone, and is combined with a series of showers to provide washing and dewatering of the pulp in the displacement zone.

The machine downstream from the headbox and the forming zone is divided into a series of washing zones or stages to which a washing liquid is applied from above for drainage through the pulp mat. The freshest or cleanest washing liquid is applied to the zone nearest the off-running end of the wire and the liquid drained through the mat at that zone is collected from the suction boxes and delivered to the immediately preceding washing zone. This is repeated from zone to zone, so that the cleanest pulp is treated with the cleanest water, and the dirtiest pulp is treated with the dirtiest water.

In most pulp washing applications, it is desirable to use tensioned fabrics, which are supplied with pin seams for ease of installation. This use of pin seams in these types of products also allows machine manufacturers to produce less expensive non-cantilevered washing systems. The problems with pin-seamed products primarily revolve around issues of strength relative to endless woven or endless seamed alternatives. Specifically, the seam area in a fabric has lower strength than the main fabric body. Depending upon the design of the fabric, the seam strength can be as low as 50% of the fabric body tensile strength. Thus a seam, which is a desirable feature, is the weakest portion of the fabric. As most pulp washing systems (vacuum slotted decks) offer the potential for high fabric wear side abrasion, seams or seam components, which are typically thicker in caliper that the body of the fabric, can experience preferentially higher wear rates resulting in seam strength reduction and premature failure (seam breaks).

To mitigate this wear-based failure, it has become a standard practice to provide some sort of sacrificial wear surface as a protective barrier to extend seam life. U.S. Pat. No. 5,791,383 describes a practice in which terminal ends from the seaming process are purposely left uncut to cover the seam area. While somewhat effective, this practice can make field installation a difficult endeavor.

An alternative practice, which does not adversely affect field installation, is the use of a CD wear bead or strip of polymeric material on either side of the seam. FIG. 1 shows a fabric 10 including a seam 16 formed of loops 12 and at least one pintle 14. The fabric 10 also includes a wear beads/strip 18. The wear beads 18 are typically placed within 10 cm, on either side of the seam 16, and are thicker in caliper than the seam 16.

The use of the wear strips 18 theoretically allows the seam 16 to essentially be free of wear until such time as the bead/strip is abraded to the caliper of the seam and seam abrasion begins. However, because of the continuous nature of these CD wear beads/strips 18, there is a high potential for catastrophic failure of the bead/strip as a result of either concentrated force along a common plane or peeling. The shear force to remove a bead/strip 18 is typically on the order of 20 times the peel strength in the cross direction. Thus, any imperfection in the wear bead/strip deposition, or any sections of the wear bead/strip that become locally damaged during pulp processing results in the wear bead/strip strength being reduced to the peel strength. Such imperfections can be caused during the manufacturing process or caused by delamination damage anywhere along the length of the bead material deposited across the width of the fabric. These imperfections ultimately result in ineffective wear protection that fails early in the fabric run.

Accordingly, the present invention is directed to overcoming these shortcomings of the prior art fabrics.

SUMMARY OF THE INVENTION

It is therefore a principal object of the invention to provide for an industrial fabric having a built-in mechanism that enables wear protection of a seam portion of an industrial fabric.

It is another of the invention to provide for a fabric where catastrophic failure of a portion of a wear protection mechanism will not result failure of all wear protection mechanisms for the fabric.

It is still another object of the present invention to provide a fabric having a wear protection mechanism that does not adversely effect on-machine seaming techniques.

The present invention is directed to an industrial fabric formed of a flat woven fabric having means for seaming the fabric to form an endless loop, and a plurality of non-continuous wear beads formed on the fabric proximally to a seam formed in said fabric.

These and other objects and advantages are provided by the present invention.

BRIEF DESCRIPTION OF THE DRAWINGS

Thus by the present invention, its objects and advantages will be realized the description of which should be taken in conjunction with the drawings wherein.

DETAILED DESCRIPTION OF THE PREFERRED EMBODIMENTS

A preferred embodiment of the present invention will be described in the context of filaments and fabrics woven therefrom used in papermaking related processes. However, it should be noted that the invention is applicable to the fabrics used in other industrial settings where seam wear prevention is of importance.

Fabric constructions are usually a system of woven yarns. These yarns may be monofilament, plied monofilament, multifilament or plied multifilament, and the fabric may be woven with a single-layer weave, a multilayer weave; or the fabric may be a laminated structure of two or more base fabrics. The yarns are typically extruded from any one of the synthetic polymeric resins, such as polyamide and polyester resins, used for this purpose by those of ordinary skill in the industrial fabric arts.

Figure 1:
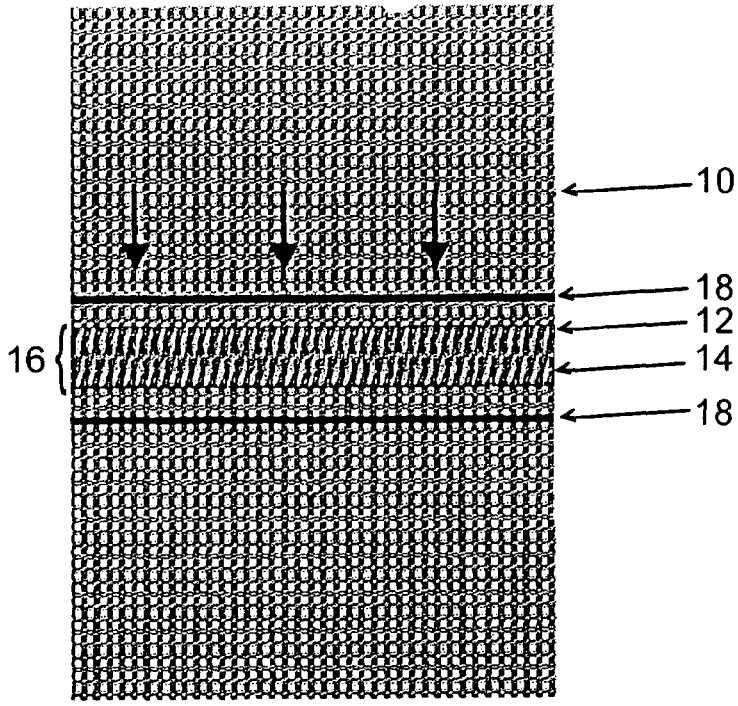
FIG. 1 (PRIOR ART)
FIG. 1 is a top view of an industrial fabric having known seam wear protection devices.
Figure 2:
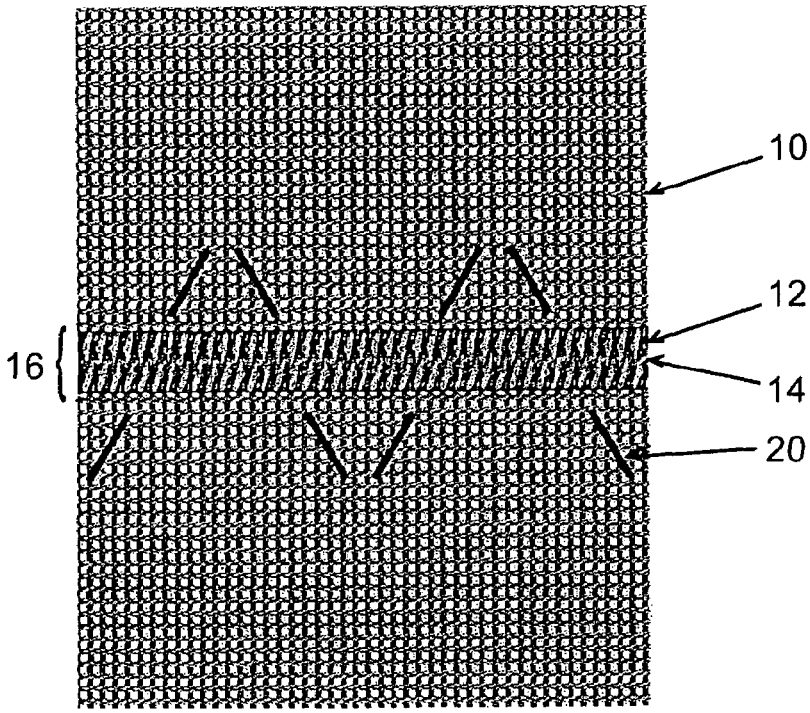
FIG. 2 is a top view of an industrial fabric having seam wear protection devices according to the present invention.

The present invention is specifically directed to a seamed fabric, which is formed flat and then made endless using a seam 16, as shown in FIG. 2. In particular, the present invention is directed to seam 16 formed using loops 12 and pintles 14, where loops 12 are formed at both ends of a flat woven fabric 10 from the machine direction MD yarns. After installation of the fabric on the machine, these loops 12 are then interdigitated in the seaming process, and one or more pintles 14 are inserted into the loops to form an endless fabric. However, the present invention is not limited to use with pintle/loop seaming techniques and can be used with other known seaming techniques such as coils affixed at the fabric ends and then interdigitated together with a pintle passed therethrough. Other applicable seaming techniques for which the invention would be applicable will be readily apparent to one skilled in the art.

As shown in FIG. 2, in order to provide durable seam protection, which does not interfere with the efficiency of seam joining during fabric installation, the wear beads 20 are staggered, and formed in a discontinuous pattern. The wear beads 20 may, for example, be placed within about 10 cm of either side of the seam 16. The pattern shown in FIG. 2 is exemplary and the present invention is not so limited. Other non-straight orientations in the cross machine direction and shapes of the wear beads 20 can be used.

Figure 3:
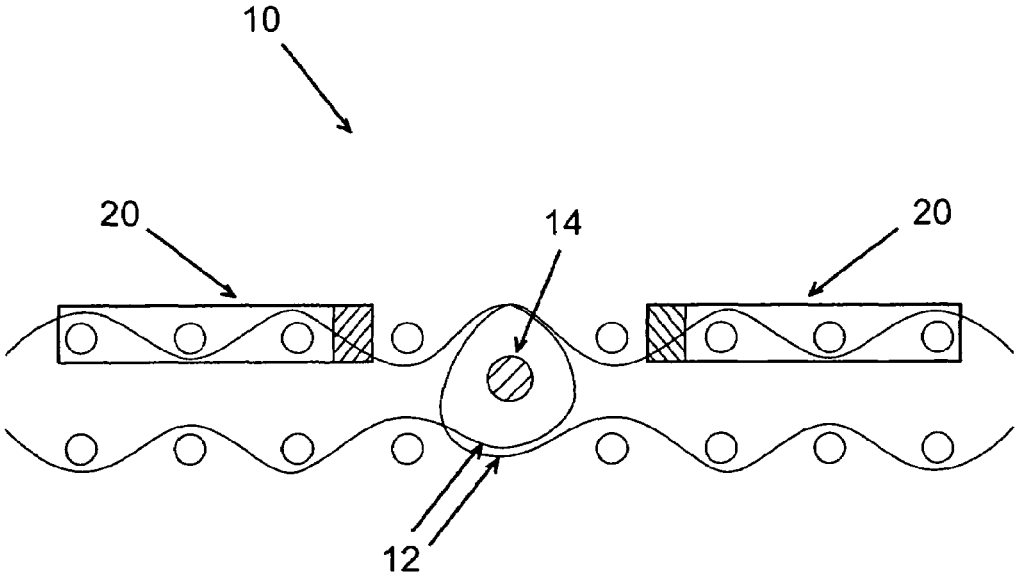
FIG. 3 is a side sectional view of an industrial fabric having protection devices according to the present invention.

In one advantageous embodiment of the present invention, the wear beads/strips 20 that are produced from polymeric materials including thermoplastics or room temperature, UV, and heat activated cross-linkable thermoset plastics. The method of adhesion of the wear bead is deposition of sufficient bead material such that encapsulation of the yarns making up the fabric body occurs while the bead itself extends above the fabric plane, on the wear side, defined by the seam thickness as shown in FIG. 3. In other words, the bead must be higher than the seam.

Among the advantages in this invention is that any imperfections in the wear bead/strip deposits or any sections of the wear bead/strip that become locally damaged during use on a pulp washer will result in localized bead failure only. In essence, the adhesion of the wear protection bead as a whole will be a function of the shear strength of the bead and not reduced to the peel strength of the bead bond with the fabric.

Shear forces, which are a result of cross machine direction CD oriented wear components are generally reduced as a result of the reduced contact area along the CD length component of the wear bead application area. That is, because a reduced CD profile is presented to any object that the wear bead 20 contacts, the shear stresses on the wear bead 20 are reduced, as the stress is a composite force which takes into account the size of the area which impacts the object and the speed of the fabric and the attached wear bead 20. By angling the wear bead, the effective surface area of the wear bead is reduced in proportion to the angle from the CD.

Further, by angling the wear bead 20 from the CD, as shown in FIG. 2, the impact of the wear bead against an object is borne by the wear bead in both the MD and CD directions. That is, the MD force which causes shear on the wear bead 20 is broken into vectors of both MD and CD forces following impact, thus reducing the sheer stress which must be absorbed by the wear bead 20 to avoid delamination from the fabric surface.

Thus by the present invention its objects and advantages are realized, and although preferred embodiments have been disclosed and described in detail herein, its scope and objects should not be limited thereby; rather its scope should be determined by that of the appended claims.

What is claimed is:

1. An industrial fabric comprising:

a fabric having a seam;

means for seaming said fabric to form an endless loop; and a plurality of non-continuous wear beads separate from the means for seaming the fabric and formed on said fabric proximally to the seam formed in said fabric.

2. The industrial fabric of claim 1, wherein said non-continuous wear beads are formed at an angle to the cross-machine direction of said fabric.

3. The industrial fabric of claim 1, wherein said non-continuous wear beads are non-straight in the cross machine direction.

4. The industrial fabric of claim 1, wherein said non-continuous wear beads are formed of a material selected from the group consisting of thermoplastics, and room temperature, UV, and heat activated cross-linkable thermoset plastics.

5. The industrial fabric of claim 1, wherein said wear beads are arranged about 10 cm from said seam.

6. The industrial fabric of claim 1, wherein said wear beads are placed on both sides of the seam.

7. The industrial fabric of claim 1, wherein said wear beads are adhered to said fabric by encapsulation of the yarns of said fabric.

8. The industrial fabric of claim 1, wherein the area of the fabric with the wear beads has a thicker caliper than the area without the wear beads, said thicker caliper prevents wearing of the seam.

* * * * *